US006420053B1

(12) United States Patent
Levinson

(10) Patent No.: US 6,420,053 B1
(45) Date of Patent: Jul. 16, 2002

(54) ARTICLES HAVING A COLORED METALLIC COATING WITH SPECIAL PROPERTIES

(75) Inventor: Leonid Levinson, Haifa (IL)

(73) Assignee: Nickel Rainbow Ltd. (IL)

( * ) Notice: Subject to any disclaimer, the term of this patent is extended or adjusted under 35 U.S.C. 154(b) by 0 days.

(21) Appl. No.: 09/600,229

(22) PCT Filed: Jan. 13, 1999

(86) PCT No.: PCT/IL99/00022

§ 371 (c)(1),
(2), (4) Date: Jul. 12, 2000

(87) PCT Pub. No.: WO99/36595

PCT Pub. Date: Jul. 22, 1999

(30) Foreign Application Priority Data

Jan. 13, 1998 (IL) ..... 122928

(51) Int. Cl.[7] ..... C25D 3/56; C25D 5/50; C25D 7/08

(52) U.S. Cl. ..... 428/658; 428/663; 428/680; 428/935; 205/181; 205/196; 205/238; 205/246

(58) Field of Search ..... 428/615, 658, 428/663, 680, 935; 148/518; 205/181, 182, 196, 210, 227, 238, 258, 246

(56) References Cited

U.S. PATENT DOCUMENTS

| | | | |
|---|---|---|---|
| 3,791,801 A | 2/1974 | Ariga et al. | 204/43 Z |
| 4,838,648 A | 6/1989 | Phillips et al. | 350/166 |
| 4,839,250 A | 6/1989 | Cowan | 430/1 |
| 5,218,472 A | 6/1993 | Jozefowicz et al. | 359/584 |

*Primary Examiner*—John J. Zimmerman
(74) *Attorney, Agent, or Firm*—Martine & Penilla, LLP

(57) ABSTRACT

An article includes a bi-colored metallic coating electrodeposited directly on a metallic cathode, such that a planar surface of the coating exhibits a visual first color when viewed from a first angle to the surface and a visual second and different color when viewed at a second angle to the surface. The electrode position is carried out from a bath which comprises ions selected from the group consisting of molybdenum(VI)-containing ions and (Ni(II)–+Zn(II))–containing ions, wherein the parameters ionic concentration, pH, bath temperature current density and current quantity are so selected that a bi-colored coating is obtained, provided that a current density is applied to the underplate as cathode within the range of 0.005 to 0.5 A/dm$^2$.

30 Claims, 1 Drawing Sheet

ARTICLES HAVING A COLORED METALLIC COATING WITH SPECIAL PROPERTIES

FIELD AND BACKGROUND OF THE INVENTION

The invention relates to an article which includes a bi-colored electroplated metallic coating, and process for its manufacture.

A previous patent application (PCT/IL97/00158, claiming priority from Israel Patent Application No. 118281, filed May 15, 1996), of the present Applicant Company, described and claimed articles and a process for making the articles, the latter including a colored electroplated metallic coating comprising both nickel and zinc, on an underplate of copper, brass, bright nickel or matt nickel, supported on a metallic or plastic substrate, the variation of color of the electroplated coating being due to factors other than variation in the identity of ions in the electrolyte, namely, electroplating parameters. Examination of the colored coatings obtained in this process showed that, while they possessed subjectively a particular color, they were analytically mixtures of different colors.

The electrodeposition of nickel on metal substrates such as steel, copper and brass, is widely used in industry in order to meet both decorative and protective requirements for a wide range of goods. The properties provided by an electrodeposited nickel surface, for engineering applications, are generally adhesion, and corrosion- and wear-resistance, hardness and ductility, while for consumer applications the same qualities are relevant, and additionally the appearance of the surface becomes of great importance as part of the decorative value of the products.

The appearance of an electrodeposited nickel coating is usually described in terms of properties such as brightness, reflectivity, tarnish resistance, smoothness, texture and so forth. For esthetic reasons, the color of the coating is also of importance, especially for consumer applications, but the possibilities for imparting intrinsic color to electrodeposited nickel are very limited.

While aluminum may be provided with an oxide film coating which imparts excellent corrosion- and wear-resistance, by an electrolytic process in which aluminum constitutes the anode—"anodizing"—and while such a coating may be successfully colored, such a technique is not applicable to nickel.

In painting technology, it is known to provide surfaces with pigmented polymeric coatings, in order to obtain articles with a colored finish, but of course the surface is not metallic, and thus cannot for example be selected to be a mirror, matt, full-bright or semi-bright finish. Moreover, the manufacturing process then requires an additional coating-pigmenting step, which it would be desirable to avoid, if this were possible.

It is also known to provide colored metallic finishes on (usually bright) electrodeposited nickel with a restricted range of colors. Thus, various hues and shades of gold can be deposited in this manner from gold cyanide electrolyte, and silver can be plated from cyanide electrolyte from a dissolving silver anode. Similarly, a dark gray-blue finish can be imparted to nickel by electrodeposited ruthenium. Such metallic finishes suffer from the following drawbacks: (a) the color range is limited to golds, silvers and gray-blues; (b) the high price of the coloring component makes such processes expensive, and in case stripping is required this would also be expensive; (c) plating from cyanide electrolytes is neither user-friendly not environment-friendly; (d) each color requires its own special electrolyte, so that the plating bath must be changed in order to change the color.

In an attempt to meet in particular the limitation of the narrow range of obtainable colors, a number of formulations have been developed for coloring metal surfaces electrolytically or by dipping. By way of example, a solution of lead acetate, sodium thiosulfate and acetic acid can produce a blue color on electrodeposited nickel; a solution of potassium chlorate, and copper and nickel sulfates can produce brown colors on brass and copper; and a solution of copper sulfate containing acetic acid and glycerol, in addition to ammonium, sodium and zinc chlorides, produces the socalled tiffany green on brass or nickel, by repeated immersion and drying of the articles in question. Production of such single colors is unlikely to be economical, and it should also be noted that similarly to the previously-mentioned overplating techniques using gold, silver or ruthenium, these colors each require particular process conditions and often exotic electrolytes or dipping solutions, so that the plating conditions and the bath must be changed in order to change the color, which features of course add to the difficulties of carrying out operations which are commercially viable. An additional problem in such cases is that the obtainable colors and hues are sensitive to slight changes in plating parameters, so that the results may depend more on the operator's skill, than on a particular formulation and plating conditions.

Another approach to solving the problem of the lack of variety of colors available by simply overplating nickel, has been the electrophoretic technique, which involves the deposition of pigment particles in the micronic size range from a pigment suspension in an electroplating bath. Although this technique does provide a variety of colors in the articles thus produced, at the same time the finishes lack the brilliance of nickel-plated articles and are tarnish-like, semi-bright colors. As we have seen in various known techniques, here too, each color requires its special coloring bath, and changing the color means changing the bath. Moreover, stripping of the color is not practical, so that if the finished article is defective in color or appearance, the defect cannot be repaired.

Although not answering consumer demand for a variety of colors, electrodeposition on a metal cathode of a black coating known as "black oxide" or "black nickel", is also commercially available, and affords a range from light gray to black anthracite. Black nickel is usually plated onto a brass or nickel base, or onto steel provided with an intermediate layer of zinc, copper or nickel. A variety of electroplating conditions and electrolyte formulations for such purposes have been described in the art, but the formulations usually contain zinc, nickel and sulfur, in thiosulfate. These formulations, generally termed "oxidizing liquid" are available in the market, in concentrated liquid form. According to U.S. Pat. Nos. 4,861,441 and 5,011,744, black nickel coatings of excellent quality are said to be obtainable in presence of a strongly oxidizing anion, and cations of Zn and a "coloring metal" i.e. Fe, Co, Ni, Cr, Sn or Cu, at a pH of 1–4, a current density of 5–100 A/dm$^2$ and a current quantity of 20–200 coulombs/dm$^2$. Somewhat similar are processes for obtaining a black electrodeposited coating, described in U.S. Pat. Nos. 4,968,391 and 5,023,146, in which the bath contains additionally a sulfur compound such as a thiocyanate or a thiosulfate, and the preferred current density is 1–50 A/dm$^2$. Also described in the literature is a process for obtaining black nickel electroplated coatings from a bath containing Ni, Zn and ammonium cations and thiocyanate anions, at a pH of from 3.5 to 6.0, and a cathode current density of 0.15–0.2 A/dm$^2$ (Dennis, J. K. & Such T. E., Nickel and Chromium Plating, 2nd Edition, Butterworth, 1986). W. Schwartz, in Plating & Surface Finishing, June 1982, pages 26–29, describes inter alia formulations for electroplating systems, in order to obtain platings of black chromium, nickel or nickel/molybdenum, or (gray) arsenic.

A phenomenon related to the problem of providing electrodeposited colored metallic surfaces is that of light interference in submicronic/micronic electroplated films, in which the color depends on film thickness. For example, cuprous oxide changes its color from an initial violet through blue, green, yellow, orange and red, due to the interference phenomenon, as the film thickness increases (see e.g. Solomon, H., Isserlis, G. and Averil, A. F., "Protective and Decorative Coatings for Metals", Finishing Publications Ltd., USA, 1978). However, this phenomenon is not commercially viable because of the unreliability of the desired color, since the slightest changes in electroplating parameters or physical variation in the metal surface, leads to an even more dramatic change, in color or hue, of the electroplated film.

H. Keping et al. in Metal Finishing, June 1996, pages 97–99, described a process in which nickel-plated mild steel was passivated cathodically in a molybdate/phosphate electrolyte, to give blue-purple, gold, green and grass-green coatings, depending on the plating time, each of the mentioned colors being of greater thickness than the one mentioned beforehand.

To the best of the present inventors' knowledge, the known art (including Keping et al.) describes only electroplated metallic coatings, each having, visually, no more than a single color. The entire contents of the above-mentioned patents and literature references are incorporated by reference herein.

OBJECTS OF THE INVENTION

A primary object of the invention is to provide a visually bi-colored electroplated coating on bright or matt nickel as underplate, and a process for the preparation thereof.

Another object of the invention is to provide a visually bi-colored electroplated coating, and a process for the preparation thereof as just recited, wherein the two colors of the visually bi-colored coating can be to some extent varied and predetermined, by selecting process parameters.

Still another object of the invention is to provide a visually bi-colored electroplated coating as aforesaid, and a process for the preparation thereof, wherein the coating has a lustrous brilliant appearance similar to a high level conventional bright or matt electroplated nickel coating.

Yet another object of the invention is to provide a visually bi-colored electroplated coating as aforesaid, and a process for the preparation thereof, wherein the ingredients of the electrolytes used are neither more expensive nor more hazardous than those used conventionally for nickel electroplating.

Yet a further object of the invention is to provide a visually bi-colored electroplated coating as aforesaid, and a process for the preparation thereof, wherein the coloring process is stable, in that acceptable variation of colors can be assured by corresponding variation within a reliable range of process parameters.

Another very important object of the invention is to provide a visually bi-colored electroplated coating as aforesaid, and a process for the preparation thereof, wherein various colors and hues of the colored coating can be produced using the same bath and the same electrolyte solution, by selecting the process parameters exclusively.

By the expression "visually bi-colored coating" and similar expressions in the present specification and claims, there is to be understood a coating which, when applied to an article including a planar surface, possesses a first visual color when such surface is viewed from a particular angle, and which when viewed from a different angle can be seen to possess a second color different from the first color. It should be noted that the combination of the two colors in the visually bi-colored coating may be a complementary combination of colors, but, as illustrated in the Examples, the invention is not limited thereto. However, since the invention naturally includes articles having a plurality of surfaces disposed at various angles with respect to the viewer, in such cases the articles will appear to be reflecting two different colors.

Other objects of the invention will be apparent from the description which follows.

SUMMARY OF THE INVENTION

In one aspect, the present invention provides an article, which may be planar or non-planar, and which includes a bi-colored metallic coating electrodeposited directly on a metallic cathode such that where the article comprises a substantially planar surface, said coating possesses a visual first color when viewed from a first angle to said surface and it possesses a visual second and different color when viewed at a second angle to said surface.

In another aspect, the present invention provides a process for manufacturing an article as defined in the preceding paragraph, which process includes the step of electrodepositing said coating on a suitable metallic cathode from an electrolyte bath which comprises ions selected from the group consisting of molybdenum(VI)-containing ions and (Ni(II)−+Zn(II))− containing ions, wherein the parameters ionic concentration, pH, bath temperature current density and current quantity are selected so that a bi-colored coating is obtained, subject to the condition that a current density is applied to said underplate as cathode within the range of 0.005 to 0.5, preferably 0.0075 to 0.25 A/dm$^2$.

The terms "electroplated", "electroplating" and similar terms have their normal meaning in the art and thus exclude, for example, other electrical processes such as electrophoresis.

It is a particular and distinctive feature of the present invention that differently colored bi-colored coatings are obtainable while maintaining the identity of the chemical ingredients in the electroplating bath, in any embodiment of the invention using a particular combination of ions. Thus, according to the invention, selection of the colors of the bi-colored coating of the invention, where the electrolyte includes, for example, molybdenum(VI)-containing ions and $(PO_4)^{3-}$ ions is not determined by adding or subtracting ingredients in the electroplating step, but is rather determined by variation of the parameters: ionic concentration, pH, bath temperature current density and current quantity.

It will accordingly be apparent that the present invention is distinct from the prior art in which gold and silver cyanides can provide, respectively, only gold and silver coatings; where the presence of ruthenium in the bath will give only blue-gray coatings; from so-called "colored" coatings which are in practice black nickel coatings; from a combination of bath ingredients which gives only the so-called "tiffany green" colored coating, from a different combination of ingredients which gives only a blue coating and from yet a different combination which gives only a brown coating. It will be apparent also that the present invention is distinct from the invention of our previous patent application PCT/IL97/00158. Moreover, the present invention achieves for the first time commercially viable electrodeposited bi-colored metallic coatings. While the present invention is not considered to be limited by any theory, it is possible that the variation in colors of the electrodeposited bi-colored metallic coating and the difference in color between the two visualized colors, is connected on the one hand with the phenomenon of light interference, and on the other hand with viewing different faces of crystalline electrodeposited metal. Presuming this to be so, then the invention for the first time combines the phenomena of light interference, according to which the color of the coating is related to its thickness and the nature of the electrodeposited crystalline metal.

DETAILED DESCRIPTION OF THE INVENTION

Figure 1:
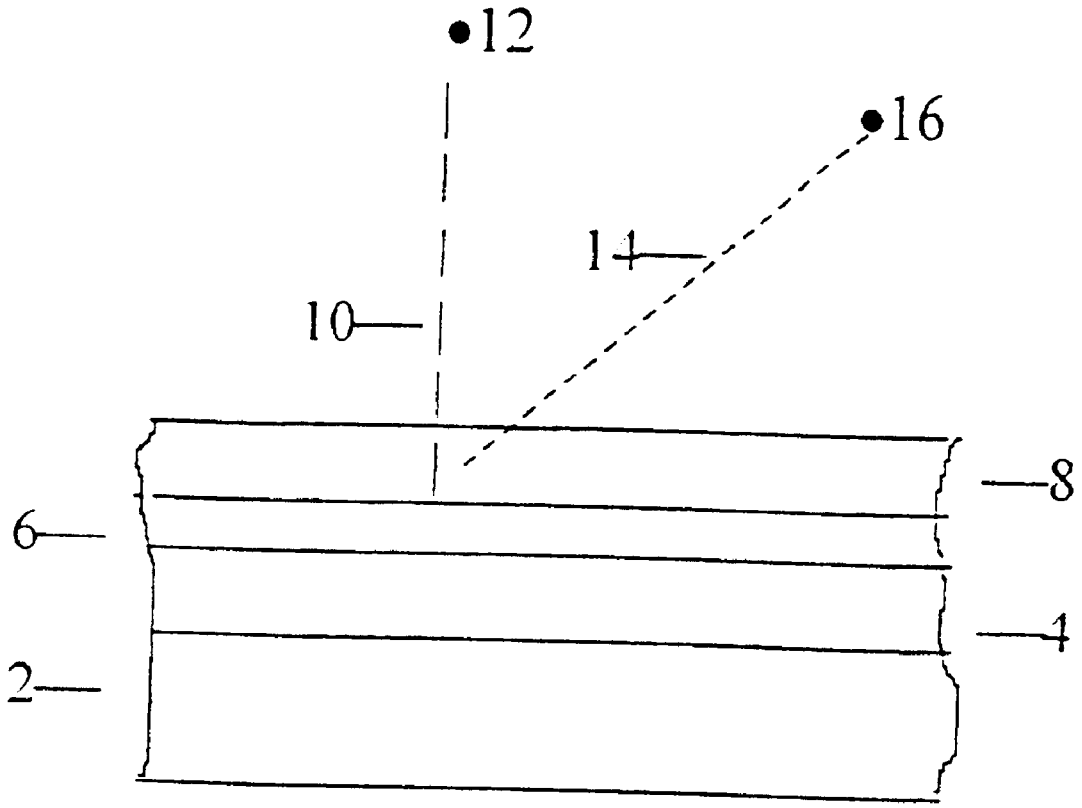
FIG. 1 is a schematic representation of a section through the periphery of an article according to an embodiment of the invention, or manufactured according to an embodiment of the process of the invention.

In FIG. 1, which is a schematic representation of a section through the periphery of an article according to an embodiment of the invention, or manufactured according to an embodiment of the process of the invention, reference numeral 2 represents a substrate layer overplated with metallic layer 4, which is otherwise referred to throughout the specification and claims as "underplate" because it constitutes a basis for the electrodeposited colored layer 6. Layer 6 may be protected by guard layer 8. In accordance with the invention, when layer 6 is viewed along the line of sight 10 from point 12, it appears to have a first color, while when layer 6 is viewed along the line of sight 14 from point 16, it appears to have a second and different color. It will be appreciated that points 12 and 16 (and lines 10 and 14, respectively) have been chosen arbitrarily for illustrative purposes only, and do not limit the invention.

Although the meaning of "bi-colored electrodeposited coating" has been defined herein with reference to a planar surface of the inventive article, it will be appreciated that the article may be non-planar; the expression "non-planar" includes articles (by way of example, machine tools) which have a plurality of surfaces disposed in different directions. In this connection, in an article of the invention which is non-planar, the surfaces will possess the first and/or second colors, depending on the angles from which each surface of the article is viewed.

In a particular embodiment, the first color of the coating may be apparent to the viewer at 90° to a planar surface, while the second color may be apparent to the viewer at 142° to the planar surface.

Illustratively, the electrolyte from which the bi-colored coating is electrolytically deposited may comprise molybdenum(VI)-containing ions and preferably also $(PO_4)^{3-}$ ions. In a different embodiment, the electrolyte comprises both Ni(II)– and Zn(II)– containing ions.

The metallic cathode on which the bi-colored coating is electrolytically deposited directly may be selected, for example, from bright nickel, matt nickel or brass. In a particular embodiment, the cathode is an underplate which has been electrolytically deposited on a substrate. Preferably, such underplate had been deposited on a substrate immediately before deposition of the bi-colored coating, or alternatively, prior to electrodeposition of the coating, the underplate had been pretreated in order to ensure substantial absence from the underplate of oxide film, absorbed gases and organic matter. The underplate has preferably a thickness of at least five microns.

The bi-colored coating has preferably a thickness within the range of 0.05–2 microns. The anode can be made of any suitable conductive but substantially insoluble material, e.g., stainless steel. Apart from the particular parameters mentioned herein, the electroplating step can be carried out in any suitable conventional electroplating apparatus using for example conventional racks, although racks made of titanium are presently preferred.

In operating the present invention, best results in relation to satisfactory adhesion of the bi-colored coating and its brilliance, may be obtained if the underplate is of high purity and uniform thickness, and if the underplate has itself a brilliant lustrous bright or matt finish. Thus, it is preferred to coat the underplate on a suitable substrate by a conventional electrolytic or electroless method and then substantially immediately afterwards electrolytically deposit the bi-colored coating on this fresh underplate. When not using a freshly deposited underplate, then in accordance with another preferred embodiment of the invention, prior to electrodeposition of the bi-colored coating, the underplate is pretreated in order to ensure substantial absence from the underplate of oxide film, absorbed gases and organic matter, such as grease.

In accordance with another preferred embodiment of the invention, the underplate has a thickness of at least five microns. Where the underplate is less than five microns in thickness, this may lead to an undesirable influence of the substrate on the appearance of the bi-colored coating, besides which stripping of such an ultra-thin underplate may sometimes occur. The substrate supporting the underplate may be metallic, for example, nickel, steel, copper or brass.

In accordance with an embodiment of the invention, the bi-colored coating has a thickness within the range of 0.05–2 microns. In the process of the invention, the electroplating step may of course be terminated, for example, when the coating has a thickness within the range of 0.05–2 microns, or when the bi-colored coating has a desired preselected color combination, or both. After completion of the electroplating step, the article is removed from the bath, and it is then normally washed with water and dried. In accordance with a particular embodiment, the bi-colored coating is thereafter optionally provided with a transparent protective film of thickness in the range of from 1 to 30 microns, e.g. by lacquering. The thus-prepared products meet all relevant ASTM requirements for indoor applications. The colors of the bi-colored coatings in the article of the invention, or provided by the process of the invention, may have various hues. Also, as the thickness of the colored coating increases, the colors are formed in a particular order, as illustrated in the Examples.

When the electrolyte plating bath contains Ni(II) and Zn(II), it is preferred that the stated ingredients are present within the following ranges of concentrations (g/l): $Ni^{2+}$ 8–15; $Zn^{2+}$ 1.5–8; and additionally $(NH_4)^+$ 3–5.5, and $(SCN)^-$ 9–20. Particularly preferred are concentrations (g/l) within the following ranges: $Ni^{2+}$ 10–11; $Zn^{2+}$ 5–7; $(NH_4)^+$ 4.5–5; $(SCN)^-$ 15–20. It may within the above-stated preferred range of concentration of ingredients, the Zn:Ni ratio is not greater than 1:1. Additionally, it is especially preferred that the Zn:Ni ratio is not smaller than 0.1:1. More generally, the effect of working outside the prescribed or preferred parameter limits is summarized in the following table:

| CHANGE IN PARAMETER | UNDESIRABLE EFFECTS |
|---|---|
| Zn:Ni ratio >1:1 | color selection uncontrolled, blackening |
| Zn:Ni ratio <0.1:1 | colors lack luster, indefinite color transition, colors becoming gray or black |
| $Ni^{2+}$ | |
| <8 g/l | unstable indefinite colors |
| >15 g/l | salt precipitation, general process deterioration |
| $Zn^{2+}$ | |
| <1.5 g/l | uncertain, disappearing colors |
| >8 g/l | unstable colors, blackening, precipitation of salts, general deterioration of the process |
| $(SCN)^-$ <9 g/l | color tends to disappear |
| $(NH_4)^+$ <3 g/l, pH <4.5 | acidification, hydrogen generation at cathode |
| $(NH_4)^+$ >5.5 g/l, pH >5.5 | precipitants in cathode area |
| temperature <15° C. | precipitation of salts |
| temperature >35° C. | blackening of coating |
| current density (A/dm$^2$) <0.005 | slow process, dull colors |
| current density (A/dm$^2$) >0.5 | process uncontrollable |

As has been stated above, the bi-color of the electroplated coating may be preselected exclusively (in any particular embodiment using a particular combination of ions) by variation of parameters selected from ionic concentration, current density, and current quantity, subject to the condition that a current density is applied to the cathode within the range of 0.005 to 0.5 A/dm$^2$.

In accordance with a particular embodiment of the invention, it is preferred to operate the electroplating step which affords the bi-colored coating in accordance with the invention, so as to obtain stable colors in the colored coating. "Stable" in this context means that there will be <10% variation in the "E-factor" (ASTM D2244-93). These tolerances in the embodiment using Ni(II) and Zn(II) may be expressed as follows:

| PARAMETER | VARIATION TOLERANCE |
|---|---|
| concentrations (g/l) of | |
| $Ni^{2+}$ | 1 |
| $Zn^{2+}$ | 0.5 |
| $(NH_4)^+$ | 0.25 |
| $(SCN)^-$ | 2 |
| current density (A/dm$^2$) | 0.005 |
| time (seconds) | 30 |
| current quantity (coulombs/dm$^2$) | 0.15 |
| pH | 0.1 |
| temperature (° C.) | 5 |

The invention will now be illustrated by the following non-limiting examples. Where color numbers are cited, these refer to the "Pantone Color Formula Guide 1000" (1995 edition), Pantone Inc., 590 Commerce Boulevard, Carlstadt, N.J. 07072-3098, USA; all coating colors are bright colors and the description of the overall color in each case, while subjective, is derived from the chromaticity diagram in CIE publication 15.2, ASTM E 308 and DIN 5033.

EXAMPLE 1

An electrolyte bath of 10 l. volume, equipped with a titanium rack and a stainless steel (insoluble) anode, contained as electrolyte an aqueous solution which was 0.12M in Mo(VI) and 0.35 M in $(PO_4)^{3-}$. The bath in this case, and in other Examples using Mo(VI) and $(PO_4)^{3-}$, contained requisite amounts of $(NH_4)_6Mo_7O_{24}$, $4H_2O$ and $Na_3PO_4$ in aqueous solution. The (ambient) temperature of the bath was 20° C. and it had a pH value of 6.6. The articles to be colored by electrodeposition according to the invention were stainless steel plates overplated with bright nickel, employed as cathode, having dimensions 128×40×1.5 mm, which had been precoated with a bright nickel electrodeposited coating of about 20 microns thickness. Immediately before applying the colored coating, the plates were activated by polishing with a slurry of fine MgO and CaO (1:1); rinsing with deionized water while ensuring unbroken coverage of the metal surface (indicating absence of organic matter); dipping in aqueous ≅10% HCl; and again rinsing with deionized water. The electrodeposition of the colored coating was carried out at a current density in mA/dm$^2$ indicated in column (a) of the Tables, infra, using a current quantity in coulombs/dm$^2$, as indicated in column (b) of the Tables, while the bath was subjected to vigorous magnetic stirring. At the end of this period, the plates were removed from the bath, rinsed with water and dried. The coating in this Example and in further Examples had a first color when viewed at a 90° angle to the surface and a second color when viewed at a 142° angle to the surface, as follows:

TABLE 1

Bi-colored Electroplated Coatings

| (a) | (b) | first color | second color |
|---|---|---|---|
| 220 | 52 | blue-green | violet |
| 110 | 26 | red | reddish |
| 55 | 13 | reddish | golden |
| 10 | 2.5 | gold | yellow |

This Example shows that, using the stated cathode, pH, temperature and Mo(VI) and $(PO_4)^{3-}$ concentrations, it is possible to obtain various bi-colored electroplated metallic coatings over a range of current densities and with relatively low current quantities.

EXAMPLE 2

When Example 1 was repeated, using as electrolyte an aqueous solution which was 0.18M in Mo(VI) and 0.52 M in $(PO_4)^{3-}$ the same bath temperature and a pH value of 6.7, the results noted in Table 2 were obtained:

TABLE 2

Bi-colored Electroplated Coatings - Effect of Increased Ionic Concentration in the Electrolyte

| (a) | (b) | first color | second color |
|---|---|---|---|
| 220 | 52 | gold | blue |
| 55 | 13 | gold | blue |
| 10 | 2.5 | gold | blue |

This Example shows that, using essentially the conditions of Example 1, but with a 50% increase in Mo(VI) and $(PO_4)^{3-}$concentrations, varying the current densities and current quantities produces substantially the same bi-colored coating, which is however different from any of the bi-colors of Example 1.

EXAMPLE 3

When Example 1 was repeated, using as electrolyte an aqueous solution which was 0.17M in Mo(VI) and 0.47 M in $(PO_4)^{3-}$ the same bath temperature and a pH value of 7.2, the results noted in Table 3 were obtained:

TABLE 3

Bi-colored Electroplated Coatings - Effect of Increased pH

| (a) | (b) | first color | second color |
|---|---|---|---|
| 220 | 52 | yellow-red | bluish |
| 55 | 13 | yellow-red | bluish |
| 10 | 2.5 | yellow-red | bluish |

This Example shows that, using essentially the conditions of Example 2, but increasing the pH to 7.2, varying the current densities and current quantities produces substantially the same bi-colored coating, which is however different from the bi-color of Example 2.

EXAMPLE 4

When Example 1 was repeated, using as electrolyte an aqueous solution which was 0.17M in Mo(VI) and 0.36 M in $(PO_4)^{3-}$ a bath temperature of 50° C. and a pH value of 7.0, the results noted in Table 4 were obtained:

TABLE 4

Bi-colored Electroplated Coatings - Effect of Increased Temperature and Current Quantities

| (a) | (b) | first color | second color |
|---|---|---|---|
| 220 | 104 | green | red |
| 110 | 52 | red | yellow |
| 55 | 26 | yellow | blue |
| 10 | 5 | blue | reddish |

This Example shows that, when increasing both the temperature and current quantities compared with Example 1, varying the current densities produces a range of bi-colored coatings, which are however different from any of the bi-colors of Example 1.

EXAMPLE 5

When Example 4 was repeated, but using instead a bath temperature of 21° C., with increased quantities of current, the results noted in Table 5 were obtained:

TABLE 5

Bi-colored Electroplated Coatings - Effect of Further Increase of Current Quantities

| (a) | (b) | first color | second color |
|---|---|---|---|
| 220 | 260 | green-yellow | red |
| 110 | 130 | green | red |
| 55 | 65 | blue-green | red |
| 10 | 12.5 | red | gold |

This Example shows that, when further increasing the current quantities compared with Example 4, but operating at ambient temperature, varying the current densities produces a range of bi-colored coatings, which are however different from any of the bi-colors of Example 4.

EXAMPLE 6

When Example 5 was repeated, but using instead a brass cathode, the results noted in Table 6 were obtained:

TABLE 6

Bi-colored Electroplated Coatings using Brass Cathode

| (a) | (b) | first color | second color |
|---|---|---|---|
| 220 | 260 | dark red | yellow-green |
| 110 | 130 | reddish-yellow | greenish-yellow |
| 55 | 65 | yellow-gold | purple |
| 10 | 12.5 | green | red |

This Example shows that, when using a brass cathode, but otherwise operating as described in Example 5, varying the current densities produces a range of bi-colored coatings, which are however different from any of the bi-colors of Example 5.

EXAMPLE 7

Using an aqueous electrolyte bath at pH 5.1 and 21°, containing 13.6 g/l $Ni^{2-}$ (as sulfate), 7.9 g/l $Zn^{2+}$ (as sulfate) and 20.7 g/l $(SCN)^{-}$ (as the ammonium salt), the result noted in Table 7 was obtained:

TABLE 7

Bi-colored Electroplated Coating from bath containing $Ni^{2+}$ and $Zn^{2+}$

| (a) | (b) | first color | second color |
|---|---|---|---|
| 150 | 54 | blue◆ | green◆◆ |

◆Pantone 3165
◆◆Pantone 371

After-treatment

In accordance with a particular embodiment of the present invention, it has been found that if an article of the invention is after-treated by coating the surface with a thin layer of oil or grease, and/or by heating the article at a temperature of 120–250° C. for a period within the range 0.1–2.0 (preferably 0.2–1.5) hours, the bi-colored electroplated coating possessed improved adhesion, while the heat-treatment may also have the effect of changing one or both of the original two colors of the bi-colored coating. This embodiment is illustrated in Example 8.

EXAMPLE 8

When the product of Example 4 (Table 4, first line) was heated at 180° C., for either 20 minutes or one hour, the color changes recorded in Table 8A were noted:

TABLE 8A

Heat treatment of Article with Bi-colored Electroplated Coatings - Effect on Colors

| time | first color | second color |
|---|---|---|
| (control) | green | red |
| 20 minutes | green | blue |
| one hour | red | yellow |

The heat-treated products were subjected to a Burnishing Test according to ASTM B-571-91. The results of heat-treatment and of an alternative after-treatment consisting of application of a thin-layer of olive oil, are recorded Table 8B:

TABLE 8B

Bi-colored Electroplated Coatings—Effect of after-treatment on adhesion

| after-treatment | blisters | lifting | peeling | scratches light pressure | scratches heavy pressure |
|---|---|---|---|---|---|
| (control) | no | no | no | yes | yes |
| oil | no | no | no | no | yes |
| heat | no | no | no | no | no |

This Example shows that after-treatment by application of heat or oil improves the adhesion of the bi-colored electroplated coatings.

Comparative Examples

A number of experiments were conducted in which the electroplating parameters were further varied, and in which bi-colored coatings of the invention were not obtained, The results of these experiments, which are set forth below tend to show the limits of the electroplating parameters which can be applied in order to obtain the inventive bi-colored coatings.

Comparative Example A

When Example 1 was repeated, using as electrolyte an aqueous solution which was 0.36M in Mo(VI) and 1.05 M in $(PO_4)^{3-}$ using the same bath temperature and a pH value of 6.86, the results noted in Table A were obtained:

TABLE A

Bi-colored Coatings—Effect of Further Increasing Ionic Concentration

| (a) | (b) | first color | second color |
|---|---|---|---|
| 220 | 52 | grey* | grey* |
| 55 | 13 | grey* | grey* |
| 10 | 2.5 | grey* | grey* |

grey* = Pantone 414

This Example shows that, using essentially the conditions of Example 1, but with a 200% increase in Mo(VI) and $(PO_4)^{3-}$ concentrations, the bi-colors of the invention are not produced.

Comparative Example B

When Example 1 was repeated, using as electrolyte an aqueous solution which was 0.27M in Mo(VI) and 1.05 M in $(PO_4)^{3-}$ using the same bath temperature and a pH value of 6.86, the results noted in Table B were obtained:

TABLE B

Bi-colored Coatings—Effect of Further Varying Ionic Concentration

| (a) | (b) | first color | second color |
|---|---|---|---|
| 220 | 52 | yellow-grey** | yellow-grey** |
| 55 | 13 | yellow-grey** | yellow-grey** |
| 10 | 2.5 | yellow-grey** | yellow-grey** |

yellow-grey** = Pantone 5783

This Example shows that, using essentially the conditions of Comparative Example A, but reducing the Mo(VI) concentration only by 25%, the bi-colors of the invention are not produced.

Comparative Example C

When Example 1 was repeated, using as electrolyte an aqueous solution which was 0.17M in Mo(VI) and 1.05 M in $(PO_4)^{3-}$ using the same bath temperature and a pH value of 4.3, the results noted in Table C were obtained:

TABLE C

Bi-colored Coatings—Effect of Decreasing pH of the Electrolyte

| (a) | (b) | first color | second color |
|---|---|---|---|
| 220 | 52 | brown*** | brown*** |
| 55 | 13 | brown*** | brown*** |
| 10 | 2.5 | brown*** | brown*** |

brown*** = Pantone 4705

This Example shows that, using essentially the conditions of Example 1p but with a 200% increase in $(PO_4)^{3-}$ concentration only, with a significant decrease in pH, the bi-colors of the invention are not produced.

Comparative Example D

When Example 4 was repeated at 21 ° C. and in absence of stirring, the resultant coating consisted of a number of lines, i.e. it was not essentially homogeneous, in contradistinction to the coatings of the invention. This result appeared to be due to the formation and retention of bubbles at the cathode.

While particular embodiments of the invention have been particularly described hereinabove, it will be appreciated that the present invention is not limited thereto, since as will be readily apparent to skilled persons, many modifications or variations can be made. Such modifications or variations which have not been detailed herein are deemed to be obvious equivalents of the present invention. By way of example only, the elements Mo and (Ni+Zn) have been utilized in embodiments particularly described herein, as essential ingredients of the electrolyte which impart the possibility (taken in conjunction with plating parameters) of obtaining the bi-colored articles according to the invention. Substitution of other viable elements such as e.g. Cu, Cr, W, V, Zr or Hf, for the particularly described elements Mo and (Ni+Zn), and/or variation of the electroplating parameters particularly described herein, are deemed to be obvious chemical and/or mechanical equivalents of the particularly described elements and electroplating parameters.

What is claimed is:

1. An article which includes a bi-colored metallic coating electrodeposited directly on a metallic cathode, such that where the article comprises a substantially planar surface, said coating possesses a visual first color when viewed from a first angle to said surface and it possesses a visual second and different color when viewed at a second angle to said surface: said article having been made by a process which includes the step of electrodepositing said coating on a suitable metallic cathode from an electrolyte bath which comprises ions selected from the group consisting of molybdenum(VI)-containing ions and (Ni(II)–+Zn(II))–containing ions, wherein the parameters ionic concentration, pH, bath temperature current density and current quantity are selected so that a bi-colored coating is obtained, subject to the condition that a current density is applied to said cathode within the range of 0.005 to 0.5 $A/dm^2$.

2. An article according to claim 1, wherein said first color is apparent to the viewer at 90° to said planar surface and said second color is apparent to the viewer at 142° to said planar surface.

3. An article according to claim 1, wherein the electrolyte from which said coating is electrolytically deposited comprises molybdenum(VI)-containing ions.

4. An article according to claim 1, wherein said electrolyte bath comprises also $(PO_4)^{3-}$ ions.

5. An article according to claim 1, wherein the electrolyte from which said coating is electrolytically deposited comprises both Ni(II)– and Zn(II)– containing ions.

6. An article according to claim 1, wherein the metallic cathode on which said coating is electrolytically deposited directly, is selected from the group consisting of bright nickel, matt nickel or brass.

7. An article according to claim 1, wherein said cathode is an underplate which has been electrolytically deposited on a substrate.

8. An article according to claim 7, wherein said underplate has a thickness of at least five microns.

9. An article according to claim 7, wherein said underplate had been deposited on a substrate immediately before deposition of said colored coating or alternatively prior to electrodeposition of said colored coating said underplate had been pretreated in order to ensure substantial absence from the underplate of oxide film, absorbed gases and organic matter.

10. An article according to claim 9, wherein said underplate has a thickness of at least five microns.

11. An article according to claim 1, wherein said bi-colored coating has a thickness within the range of 0.05–2 microns.

12. An article according to claim 1, which has been subjected to an after treatment comprising at least one of the following two treatments, namely:

heating the article at a temperature of 120–250° C. for a period within the range 0.1–2.0 hours;

application of a thin layer of oil or grease.

13. An article according to either claim 12, wherein said bi-colored coating is provided with a transparent protective film of thickness in the range of from 1 to 30 microns.

14. An article according to claim 1, wherein said bi-colored coating is provided with a transparent protective film of thickness in the range of from 1 to 30 microns.

15. A process for manufacturing an article which includes a bi-colored metallic coating electrodeposited directly on a metallic cathode, such that where the article comprises a substantially planar surface, said coating possesses a visual first color when viewed from a first angle to said surface and it possesses a visual second and different color when viewed at a second angle to said surface; which process includes the step of electrodepositing said coating on a suitable metallic cathode from an electrolyte bath which comprises ions selected from the group consisting of molybdenum(VI)-containing ions and (Ni(II)–+Zn(II))– containing ions, wherein the parameters ionic concentration, pH, bath temperature current density and current quantity are selected so that a bi-colored coating is obtained, subject to the condition that a current density is applied to said cathode within the range of 0.005 to 0.5 $A/dm^2$.

16. Process according to claim 15, wherein said cathode is an underplate which has been deposited on a substrate immediately before deposition of said bi-colored coating or alternatively said underplate has been pretreated in order to ensure substantial absence therefrom of oxide film, absorbed gases and organic matter.

17. Process according to claim 16, wherein said underplate has a thickness of at least five microns.

18. Process according to claim 17, which includes the additional step of providing the colored coating with a transparent protective film of thickness in the range of from 1 to 30 microns.

19. Process according to claim 16, wherein said underplate is supported on a metallic substrate.

20. Process according to claim 19, wherein said metallic substrate is selected from the group consisting of nickel, steel, copper and brass.

21. Process according to claim 20, which includes the additional step of providing the colored coating with a transparent protective film of thickness in the range of from 1 to 30 microns.

22. Process according to claim 19, which includes the additional step of providing the colored coating with a transparent protective film of thickness in the range of from 1 to 30 microns.

23. Process according to claim 16, which includes the additional step of providing the colored coating with a transparent protective film of thickness in the range of from 1 to 30 microns.

24. Process according to claim 15, wherein the electroplating step is terminated when the bi-colored coating has a thickness within the range of 0.05–2 microns.

25. Process according to claim 24, which includes the additional step of providing the colored coating with a transparent protective film of thickness in the range of from 1 to 30 microns.

26. Process according to claim 15, wherein the electroplating step is terminated when the bi-colored coating has a desired preselected color combination.

27. Process according to claim 26, which includes the additional step of providing the colored coating with a transparent protective film of thickness in the range of from 1 to 30 microns.

28. Process according to claim 15, wherein the bi-colored coating is subjected to an after treatment comprising at least one of the following two treatments, namely:

heating the article at a temperature of 120–250° C. for a period within the range 0.1–2.0 hours;

application of a thin layer of oil or grease.

29. Process according to claim 28, which includes the additional step of providing the colored coating with a transparent protective film of thickness in the range of from 1 to 30 microns.

30. Process according to claim 15, which includes the additional step of providing the colored coating with a transparent protective film of thickness in the range of from 1 to 30 microns.

* * * * *